US006104818A

United States Patent [19]

Körner

[11] Patent Number: 6,104,818

[45] Date of Patent: Aug. 15, 2000

[54] MICROPHONE CIRCUIT

[75] Inventor: Peter Körner, Lund, Sweden

[73] Assignee: Dalloz Safety AB, Billesholm, Sweden

[21] Appl. No.: 08/838,038

[22] Filed: Apr. 22, 1997

[30] Foreign Application Priority Data

Apr. 22, 1996 [SE] Sweden ..... 9601519

[51] Int. Cl.[7] ..... H04R 3/00

[52] U.S. Cl. ..... 381/113

[58] Field of Search ..... 381/113, 112, 381/111, 114, 95, 174, 173, 175, 122, 118

[56] References Cited

U.S. PATENT DOCUMENTS 4,414,433 11/1983 Horie et al. ..... 381/113

4,518,829 5/1985 Boeckmann ..... 381/113

*Primary Examiner*—Vivian Chang

[57] ABSTRACT

A microphone circuit with low distortion and having the capability of an electronic volume control. The circuit includes a capacitor microphone cap provided with a field effect transistor at the output end and a capacitor connected to the output end of the microphone cap. A resistance for supplying a driver voltage to the microphone circuit is connected to a connecting point between the microphone cap and the capacitor. Preferably a transistor adapted to generate a driver voltage for the microphone circuit or an electronic valve is connected between the microphone cap and the connecting point. The emitter of the transistor is then connected to the collector of the field effect transistor and the collector of the transistor is connected to the connecting point.

10 Claims, 3 Drawing Sheets

MICROPHONE CIRCUIT

FIELD OF THE INVENTION

The present invention relates to a low distortion microphone circuit having the capability of an electric volume control. The microphone circuit includes a capacitor microphone cap at the output side provided with a field effect transistor and a capacitor connected to the microphone cap output side and a resistance for applying a driver voltage to the microphone circuit being connected to a connecting point between the microphone cap and the capacitor.

RELATED ART

Capacitor microphone circuits, or so-called electrostatic microphone circuits of the kind mentioned above, especially even comprising electret microphone circuits, are already known and are widely used. An electret microphone is a capacitor microphone with a permanent electric charge not requiring any high driver voltage. The microphone cap itself is very sensitive and comprises a flexible membrane and a stationary counter electrode together providing a capacitor element, the field effect transistor, preferably of the JFET-type, being serially connected to said capacitor element. Any movement of the membrane generates variations in voltage, the voltage superimposing the microphone driver voltage. Due to this fact, a risk of a non linearity is real, which thereafter leads to distortion of the microphone circuit's output signal. For handling this problem, it is necessary to provide an external volume control device after the actual microphone circuit, which could be either a manually controlled potentiometer or a voltage controller amplifier.

SUMMARY OF THE INVENTION

The object of the invention is to provide a microphone circuit in its design being simpler than previous known circuits and providing moreover a low distortion with the possibility of a simplified electronic volume control. This object is achieved by means of a microphone circuit of the type mentioned above characterized in that a transistor adapted to generate a control voltage for the microphone circuit or an electronic valve is inserted between the microphone cap and said connected point, the transistor emitter being connected with the collector of the field effect transistor and the transistor collector with said connecting point.

Advantageous embodiments of the new microphone circuit are described in the secondary claims.

BRIEF DESCRIPTION OF THE DRAWINGS

The invention will be described in the form of preferred execution examples wherein like elements are represented by like reference numerals wherein.

DETAILED DESCRIPTION

Figure 1:
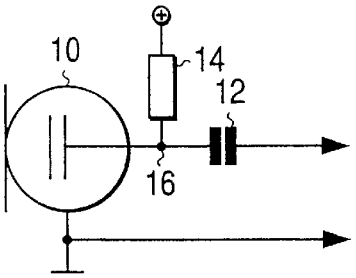
FIG. 1 (PRIOR ART)
FIG. 1 shows a circuit diagram of a conventional electret microphone circuit in a basic design according to the principles of the invention.

The circuit diagram shown in FIG. 1 relates to a conventional known capacitor microphone circuit which includes microphone cap 10 serially connected with a capacitor 12 and a resistance 14 connected with a connecting point 16 between the microphone cap 10 and the capacitor 12. The driver voltage of the microphone cap 10 is coming from the alternative current supplied by the resistance 14. By means of the capacitor 12, the direct current voltage at the connecting point 16 is eliminated. This direct current voltage serves as the driver voltage for the microphone cap 10. The output signal from the microphone circuit thus consists of the output signal from the microphone cap 10 superimposing the driver voltage signal. The signal coming from the microphone circuit in FIG. 1 might thus be non linear and therefore also distorted. The conventional microphone circuit shown in FIG. 1 is typically connected to a volume control device, an amplifier and a loudspeaker in a conventional way (not shown in FIG. 1).

Figure 2:
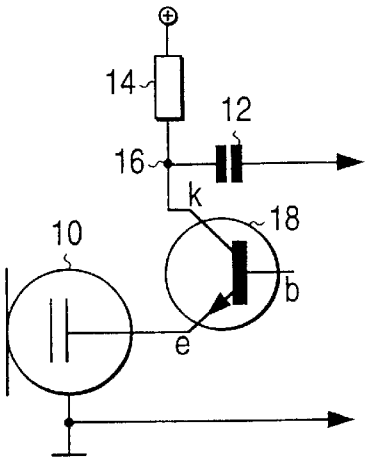
FIG. 2 shows a circuit diagram of an electret microphone circuit in a basic design according to the principles of the invention.

The principle of the new microphone circuit according to the invention can be seen in FIG. 2. The circuit diagram shown in the figure differs from the circuit diagram in FIG. 1 in that a transistor 18 is inserted between the connecting point 16 and the microphone cap 10. In FIG. 2 this transistor is illustrated as a bipolar NPN-transistor, but might also consist of a field effect transistor—JFET or a MOSFET. The NPN-transistor is more preferable since it provides low output impedance and good control possibilities. If a very strong output signal is desired, however, a durable transistor of the MOSFET type might be used. A convenient voltage is applied to the base b of the transistor 18. The transistor 18 added according to the invention provides, along with the field effect transistor 20 of the microphone cap 10 (see FIG. 3) a cascode circuit providing various advantages.

In a circuit according to FIG. 2, the alternating voltage of microphone cap 10 is no longer superimposing its driver voltage. In the case where the base b of the transistor 18 is connected to a fairly low impedance, the transistor 18 will act as an emitter follower with a low impedance at its emitter e supplying the microphone cap 10 with a driver voltage. If the voltage at the base b of the transistor 18 is kept stationary and without any alternating voltage components, the voltage at emitter e will be a pure direct current voltage without any superimposing signals. The alternating voltage signal, however, is passed through the collector k of the transistor 18; thus the risk for distortion is reduced. The use of the bipolar NPN- layer transistor 18 of FIG. 2 will optimize this effect. Since the emitter output impedance of the transistor 18 is lower than the corresponding output impedance of a field effect transistor or a valve, when the voltage at the base of transistor 18 has to be adjusted (usually within an area of 0.5 to 3 volt), the drive voltage of the microphone cap 10 is thereupon adjusted at emitter e of the transistor 18, with the end result being that microphone sensitivity is changed. This cascode connected circuit including the field effect transistor (JFET) 20 of the microphone cap 10 and the external transistor 18 therefore act in the same way as a voltage controlled amplifier (VCA) when a driver voltage is connected to the base b of the transistor 18.

Figure 3:
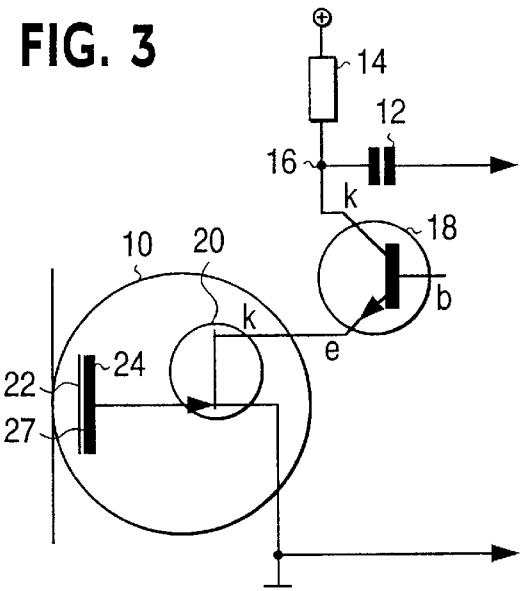
FIG. 3 shows a circuit diagram more in detail for an electret microphone circuit according to FIG. 2.

The microphone circuit in FIG. 3 is the same as the one shown in FIG. 2, but the design of the actual microphone cap 10 has been further denied. A capacitor element 27 with its membrane 22 and its stationary electrode 24 are thus illustrated and, moreover, the connection of the field effect transistor (JFET) 20 at the output of the microphone cap 10. The field effect transistor 20 acts as an impedance converter and is used since the capacitor element 27 has a very high impedance. According to the drawing, the emitter e of the transistor 18 is connected to the collector k of the field effect transistor 20.

Figure 5:
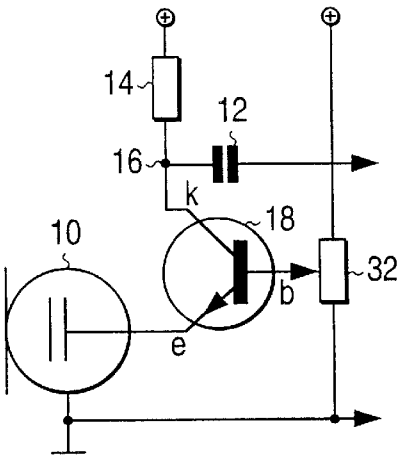
FIG. 5 shows a circuit diagram for an electret microphone circuit according to the invention in another embodiment of it.
Figure 4:
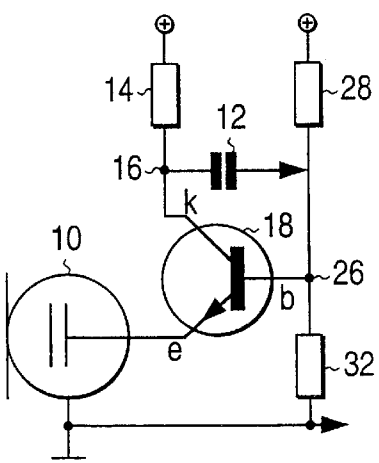
FIG. 4 shows a circuit diagram for an electret microphone circuit according to the invention in a special embodiment of it.

The circuit diagram of FIG. 4 shows the base b of the transistor 18 connected to a point 26 between two stationary resistances 28, 30 in a voltage dividing circuit. FIG. 5 shows the base b of the transistor 18 connected to a potentiometer circuit with variable resistance parts of a resistance 32.

Figure 6:
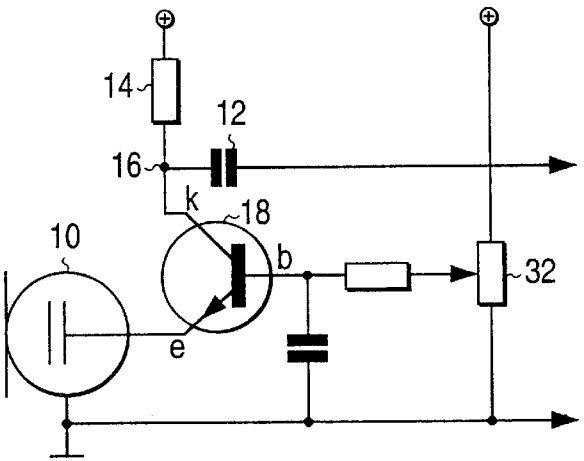
FIGS. 6 to 8 show further advantageous embodiments of microphone circuits based on the main principle of the invention.
Figure 7:
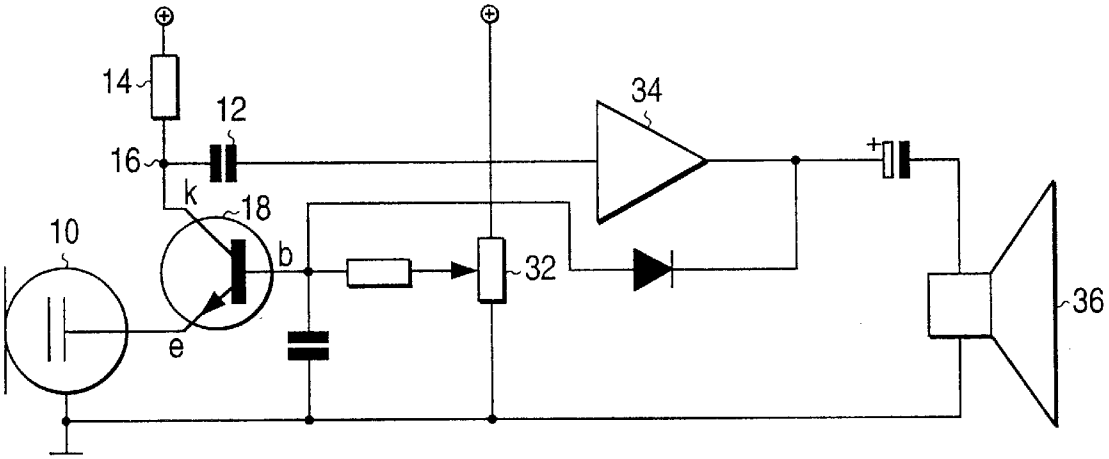
Figure 8:
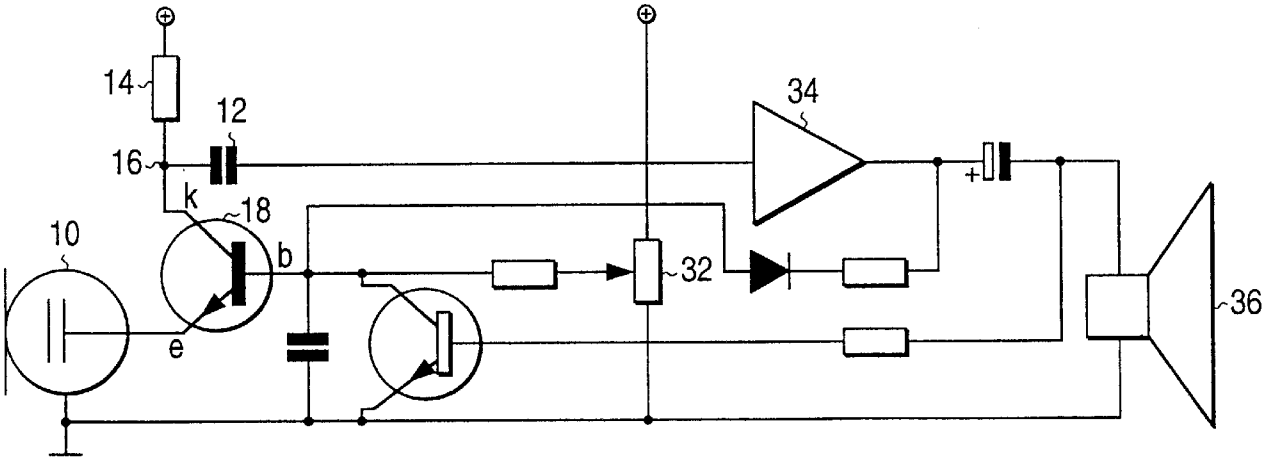

The connection arrangements in FIGS. 6 to 8 show further embodiments of the invention. The base circuit in FIG. 2 is there supplemented in various ways for a further stabilisation of the new computer circuit and to possibly provide an improved control and thus an increased performance of the circuit.

In FIGS. 7 and 8 is also illustrated, that amplifying elements exist in the external circuit as well as external loudspeakers 36.

Further modifications basing on the basic principle in FIG. 2 might of course be provided within the scope of the inventive idea.

The microphone circuit of the present invention provides the following advantages:

lowers the distortion by means of an improved linearity, might be combined with a volume control in the actual microphone, enables, in a simple way, to connect a limiting circuit, limiting the output level of the microphone cap during strong input signals, in parallel with the volume control, reduces essentially the number of components comprised in conventional circuits for the same intended object and thus provides a compact design, and provides a better amplification in comparison with what had been obtained in a conventional circuit, the circuit having a stationary constant point separating the vents in the preferred embodiment into two different portions of it.

What is claimed is:

1. A microphone circuit comprising:

a capacitor microphone cap which includes a first field effect transistor serially connected at an output end thereof;

a capacitor connected to said output end;

a resistor for supplying a driver voltage to the microphone circuit, wherein one end of said resistor and said capacitor are connected to said output end, forming a connection point; and a second transistor interposed between said first transistor and said connection point so that said first and second transistors form a cascode circuit, wherein said second transistor reduces distortion in the microphone circuit and is adapted to generate a driver voltage for the microphone circuit, and wherein the emitter of said second transistor is connected to the collector of said first transistor, the collector of said second transistor being connected to said connection point.

2. A microphone circuit according to claim 1, wherein the base of the second transistor is connected to a point between two stationary resistances in a voltage dividing circuit.

3. A microphone circuit according to claim 1, wherein the base of the second transistor is connected to a potentiometer circuit with variable resistance elements.

4. A microphone circuit according to claim 1, wherein the base of the second transistor is connected to an electronic circuit for controlling amplitude of an output signal.

5. A microphone circuit according to claim 4, wherein the electronic circuit is a signal limiting device.

6. A microphone circuit according to claim 4, wherein the electronic circuit is a signal compressing device.

7. A microphone circuit according to claim 1, wherein the second transistor is an NPN-type bipolar transistor.

8. A microphone circuit according to claim 1, wherein said capacitor microphone cap includes electret type capacitor elements.

9. The microphone circuit of claim 1, wherein an electronic valve is interposed between said first transistor and said connection point instead of said second transistor.

10. The microphone circuit of claim 1, wherein said first and second transistors act as a voltage controlled amplifier to control drive voltage of the microphone cap when a driving voltage is applied at the base of the second transistor, thereby obviating the need for an external voltage control device attached to the microphone circuit.

* * * * *